US008130104B1

(12) United States Patent
Braiman

(10) Patent No.: US 8,130,104 B1
(45) Date of Patent: Mar. 6, 2012

(54) TRACKING OBJECTS CROSSING A BORDER LINE BETWEEN TWO ZONES

(75) Inventor: Michael Braiman, Netanya (IL)

(73) Assignee: Precyse Technologies, Inc., Atlanta, GA (US)

( * ) Notice: Subject to any disclaimer, the term of this patent is extended or adjusted under 35 U.S.C. 154(b) by 0 days.

(21) Appl. No.: 12/646,039

(22) Filed: Dec. 23, 2009

Related U.S. Application Data

(63) Continuation of application No. 11/824,805, filed on Jul. 2, 2007, now abandoned.

(60) Provisional application No. 60/817,995, filed on Jun. 30, 2006.

(51) Int. Cl.
*G08B 13/14* (2006.01)

(52) U.S. Cl. ..... 340/572.4; 340/572.1

(58) Field of Classification Search ..... 340/572.1, 340/572.4

See application file for complete search history.

(56) References Cited

U.S. PATENT DOCUMENTS 4,000,400 A * 12/1976 Elder ..... 377/2
4,303,851 A * 12/1981 Mottier ..... 377/6
5,187,688 A * 2/1993 Saruta ..... 367/96
5,227,803 A * 7/1993 O'Connor et al. ..... 342/442
5,661,457 A 8/1997 Ghaffari et al.
7,026,924 B2 * 4/2006 Degrauwe et al. ..... 340/523
7,075,412 B1 7/2006 Reynolds et al.
7,821,416 B2 * 10/2010 Venture et al. ..... 340/673
2003/0067396 A1 4/2003 Hassett
2003/0201321 A1 * 10/2003 Maloney ..... 235/384
2004/0036623 A1 2/2004 Chung

* cited by examiner

*Primary Examiner* — Jennifer Mehmood
*Assistant Examiner* — Andrew Bee
(74) *Attorney, Agent, or Firm* — Duane Morris LLP

(57) ABSTRACT

The present invention discloses a tracking apparatus and system thereof, useful for objects affixed with a smart tags entering and exiting an enclosed area through a gate. A gate consists of two directional antennas directed respectively inward and outward from the gate crossing line and connected to an RF beacon. Each smart tag affixed to an object approaching the gate area, receives a transmission of ID associated with each directional antenna. The smart tag detects crossing of the gate line and direction of crossing by method of processing the ID of the two directional antennas. The detected crossing data is transmitted via a wireless communication link, to a base station located at the enclosed zone. The base station transmits the gate detection data to a service center.

21 Claims, 4 Drawing Sheets

TRACKING OBJECTS CROSSING A BORDER LINE BETWEEN TWO ZONES

CROSS-REFERENCE TO RELATED APPLICATION

This application is a continuation of U.S. patent application Ser. No. 11/824,805 filed Jul. 2, 2007 now abandoned which claims priority to Provisional Application Ser. No. 60/817,995 filed on Jun. 30, 2006, which are all hereby incorporated by reference herein in their entireties.

FIELD OF THE INVENTION

The present invention generally relates to an object tracking system and specifically relates to detecting an object crossing a line bordering two zones.

BACKGROUND OF THE INVENTION

One of the applications of computerized object tracking is controlling people and object movement through a gate into and out of a restricted area enclosed by the gate. Conventionally, gate sensors are using optical devices ranging from simple non invisible infrared beams to video cameras directed to the gate area combined with image processors. Other conventional access control system of a gate use radio frequency identification (RFID) technology to detect movement of vehicles or people through a gate. RFID Systems consist of a transponder (tag), which is a microchip connected to an antenna. The tag affixed to an item is communicating with a reader device via radio waves. Depending on the type of tag used, the reader can receive detailed information or can receive data as simple as an identification number. The basic types of RFID tags can be classified as read/write and read only. The data stored on read/write tags can be edited, added to, or completely rewritten, when the tag is within the range of a reader. Data stored on a read only tag can be read, but cannot be edited in any way. In a gate sensor application, an RFID reader is disposed at the gate and objects like vehicles have RFID tags attached to them. When the vehicle passes through the gate, the gate RFID reader identifies the crossing vehicle by communicating with the RFID tag. RFID tags are used for example for automatically charging car drivers passing through highway toll booths. An RFID reader mounted on a toll gate identifies RFID tagged cars crossing the toll gate at high speed, by receiving identification data from their tags. The gate RFID readers are linked through a communication network to a central controller.

In a number of applications, conventional gate sensors face complicated and challenging operational conditions. A vehicle, for example, may stop at the gate area, maneuver in the area close to the gate and change direction of movement near the gate area. A conventional optical or RFID gate detector may give a false detection of gate crossing under this condition. The various modes of motion through a gate entails that a reliable detection of gate crossing of a gate sensor has can become a non trivial problem. Furthermore, gate crossing can be distributed at unattended remote sites that do not provide service and support means for a gate crossing detector.

U.S. Pat. No. 5,661,457 (Ghaffari et al.), which is discussed here for reference, discloses a directional antenna configuration for use in an article tracking system that includes two shorted loops, one on each side of a portal and in each case circumscribing the portal. The antenna configuration also includes a respective pair of passage antennas provided on each side of the portal. The passage antennas are all arranged in planes parallel to the path of travel through the doorway. The respective loops confine the effective detection areas of each pair of passage antennas to the respective side of the portal. The antenna configuration permits reliable detection of direction of movement through the portal. Gate crossing detection disclosed in this invention provides improved moving direction capability, however, the system configuration, whereas the detector is connected to a central unit, is adaptable to detection of crossing gates to enclosed areas does not address the broader issue of zone crossing in remote unattended areas.

Thus there is long felt need for a gate crossing detector, capable of adequately and reliably determine gate crossing and direction gate crossing with an extended capability detection of line crossing in unattended remote areas.

SUMMARY OF THE INVENTION

It is the object of this invention to disclose an apparatus for detecting the crossing of a border line section between a first zone and a second zone, comprising: an antenna assembly located near said border line section, comprising: a first section connected to a first transmitter and a second section connected to a second transmitter. Said first antenna section is directed from said border line section toward said first zone and said second antenna section is directed from said border line section toward said second zone and a smart tag that can be affixed to an object, wherein said smart tag detects an event of said tag crossing said border line section, by receiving transmission of identification data of said first antenna section when said smart tag is in said first zone and receiving transmission of identification data of said second section when said smart tag is in said second zone and by following said sequence of received identification data.

Another object of the present invention is to disclose an apparatus as defined by any of the above, wherein said first antenna section comprising a first linear antenna and said second antenna section comprising a second linear antenna, wherein said linear antennas are mounted back to back.

Another object of the present invention is to disclose an apparatus as defined by any of the above, wherein said first linear antenna is connected to a first channel of a beacon and said second linear antenna is connected to a second channel of said beacon.

Another object of the present invention is to disclose an apparatus as defined by any of the above, comprising a phased antenna array driven by an RF signal for configuring a radiation pattern similar to said first linear antenna and said second linear antenna mounted back to back.

Another object of the present invention is to disclose an apparatus as defined by any of the above, wherein said first antenna is connected to a first beacon and said second antenna is connected to a second beacon.

Another object of the present invention is to disclose an apparatus as defined by any of the above, configured as a system, comprising a plurality of said smart tags affixed to a plurality of objects, wherein said smart tags transmit to a base station of said system via a wireless communication link, reports associated with said detected border line section crossing from said one zone to said second zone and vice versa.

Another object of the present invention is to disclose a system as defined by any of the above, wherein said base station is connected via an IP network to a service center comprising a central processing server and a customer application server.

Another object of the present invention is to disclose a system as defined by any of the above, comprising an enclosed zone and at least one gate, each of said plurality of smart tags detects gate entrance and gate exit and reports to said service center said gate entrance and gate exit.

Another object of the present invention is to disclose a system as defined by any of the above, wherein said cross line section between said first zone and said second zone are in an outdoor setting.

Another object of the present invention is to disclose a method for detecting the crossing a border line section between a first zone and a second zone from said first zone to second zone and vice versa, comprising: providing an antenna. Said antenna comprising: a first section connected to a first transmitter, and a second section connected to a second transmitter. Said first antenna section is directed from said border line section toward said first zone and said second antenna section is directed from said border line section toward said second zone, and providing a smart tag affixed to an object, wherein detecting an event of said tag crossing said border line section comprising receiving by said smart tag identification transmission of said first antenna section when said smart tag is in said first zone and identification transmission of said second section when said smart tag is in said second zone, is processed by a tag state machine.

Another object of the present invention is to disclose a method as defined by any of the above, comprising detecting an event said smart tag crossing of said border line from said first zone to said second zone and vice versa.

Another object of the present invention is to disclose a method as defined by any of the above, comprising alternating in time identification transmission of said first antenna section and identification transmission of said second antenna section.

Another object of the present invention is to disclose a method as defined by any of the above, comprising assigning a first integer as identification number for said first antenna section and a second integer as identification number for said second antenna section.

Another object of the present invention is to disclose a method as defined by any of the above, comprising assigning said first integer an even number and assigning said second integer an odd number greater by one from said first integer.

Another object of the present invention is to disclose a method as defined by any of the above, comprising providing said detection of crossing said border line section by said tag state machine; said state machine, comprising a first branch and a second branch Another object of the present invention is to disclose a method as defined by any of the above, comprising operating continuously a receiver of said smart tag receiver during a standby state of said state machine Another object of the present invention is to disclose a method as defined by any of the above, comprising entering a start state of said state machine when said first antenna section or said second antenna section are transmitting identification data, Another object of the present invention is to disclose a method as defined by any of the above, comprising entering a lock state, and staying in said lock state of said state machine when said tag is receiving said identification transmission from only said first antenna section or only from second antenna section.

Another object of the present invention is to disclose a method as defined by any of the above, comprising entering a crossing report state of said state machine when receiving said second antenna section identification transmission following receiving said first antenna section identification transmission, and said second antenna transmission stops, or comprising entering a report state when receiving said first antenna section identification transmission following receiving said second antenna section identification transmission stops.

Another object of the present invention is to disclose a method as defined by any of the above, comprising entering a sleep state of said state machine after detecting said line section crossing from said one zone to said second zone.

BRIEF DESCRIPTION OF THE FIGURES

The object and the advantages of various embodiments of the invention will become apparent from the following description when read in conjunction with the accompanying drawings wherein, FIG. 1 schematically represents a block diagram of the system according to one embodiment of the present invention.

DETAILED DESCRIPTION OF THE EMBODIMENTS

Figure 1:
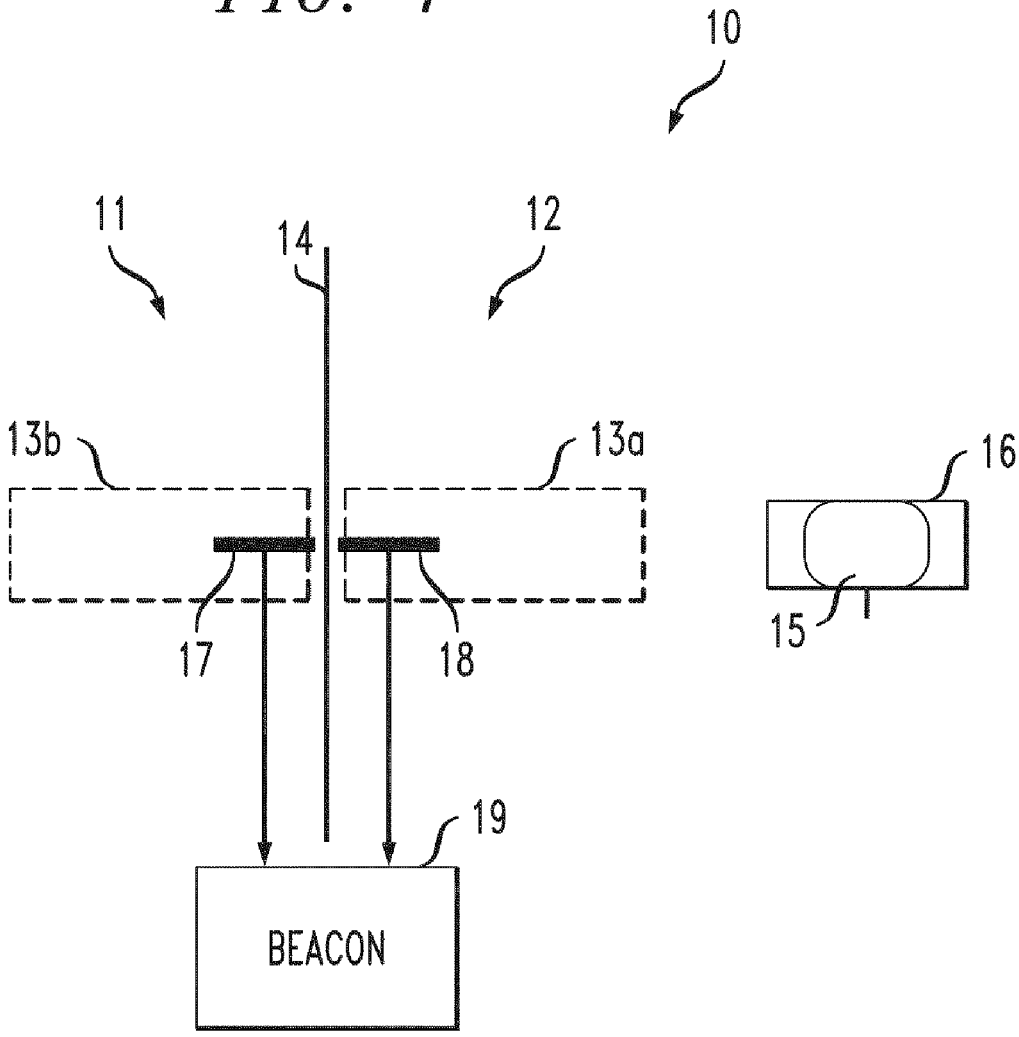

The following description is provided alongside all chapters of the present invention, so as to enable any person skilled in the art to make use of said invention and sets forth the best modes contemplated by the inventor of carrying out this invention. Various modifications however, will remain apparent to those skilled in the art, since the generic principles of the present invention have been defined specifically to provide a wireless communication system for tracking assets and methods thereof.

In the following detailed description, numerous specific details are set forth in order to provide a thorough understanding of embodiments of the present invention. However, those skilled in the art will understand that such embodiments may be practiced without these specific details. Reference throughout this specification to "one embodiment" or "an embodiment" means that a particular feature, structure, or characteristic described in connection with the embodiment is included in at least one embodiment of the invention. Thus, the appearances of the phrases "in one embodiment" or "in an embodiment" in various places throughout this specification are not necessarily all referring to the same embodiment or invention. Furthermore, the particular features, structures, or characteristics may be combined in any suitable manner in one or more embodiments.

The system accommodates a line crossing detector for tracking objects crossing through a border line between two zones. The system consists of two directional antennas mounted back to back in opposite directions at a crossing line. The antennas are connected to an RF beacon consisting of transmitter electronics for transmitting the antennas' signals. A plurality of smart tags affixed to the objects, are communicating with the beacon to identify an object crossing the border line. Unlike with conventional RFID tags which play a passive role in the system configuration, the system tags are broader in scope consisting of processing power and communication capabilities. Identification data (ID), transmitted by the directional antennas, are received by a tag approaching the crossing line area. The antenna ID information, received by a tag is used by the tag processing power to determine the direction and instant of line crossing. Antenna ID data is transmitted from a beacon and received by any tags located near the crossing line. Each tag follows the associated beacon signal and processes the signals of the two antennas to determine the event of that tag crossing the border line.

The main component of the line crossing detector is an assembly of two radio frequency (RF) directional antennas. A directional antenna is an antenna that has a narrow angle radiation pattern, i.e. the antenna radiates greater power in one direction. The gate antenna assembly consists of two identical or similar directional antennas mounted back to back and facing in opposite directions. The antennas are connected to a beacon consisting of RF transmitter electronics. One antenna direction is towards a first zone and a tag located in the first one receives the signal of that antenna. The other antenna direction is toward a second zone and a tag located in the second zone receives the signal of that antenna. Crossing direction of the border line is reliably detected by each tag communicating with the beacon and processing the data online.

The term 'Directional antenna' relates to an antenna that has a narrow angle radiation pattern.

The term 'Radio frequency (RF) beacon' relates to a radio transmitter transmitting identification data in a limited area of the transmitter antenna.

The term 'Central processing server' relates to a central processing platform recording gate crossing data obtained from all the system smart tags, in data base.

The term 'Application server' relates to a user interface platform

The term 'Application interface (API)' relates to user interface software running on the central processing server and the application server.

The term 'Line crossing detector' is relating to an apparatus detecting crossing the border line between two zones in any direction.

The term 'Wake up signal' relates to an ID transmission by the RF beacon getting the smart tag out of sleep mode.

The term 'Wake up range' relates to the maximum distance from the gate that an ID transmission of the gate antenna can make the wake up the smart tag.

The term 'Beacon zone' relates to the combined area of the two antennas where beacon identification transmission can be received by a smart tag.

The term 'State machine' relates to a graphical presentation of the method steps used by a tag to detect crossing of a gate line in either direction.

The term 'IP' is an acronym to internet protocol.

The system can be used for example, for automatically controlling a fleet of rental cars entering and existing the parking lot of the rental car company. Alternatively, the system can be applied to a fleet of trucks coming and going into a central enclosed location. The system can be applicable to other objects and people for security, badge control or asset management.

Reference is now made to FIG. 1 schematically illustrating a block diagram of a tracking apparatus according to one embodiment of the present invention. The objective of tracking apparatus 10 is to track object 16 when crossing the border line 14 between first zone 11 and second zone 12. A tag 15 affixed the object 16, which represents a plurality of system objects and tags, facilitates the detection of the object crossing border line 14 and the direction of the border line crossing. Inside directional antenna (IDA) 17, directed toward zone 11, is connected through one channel to beacon 19 consisting of antenna transmitter electronics. Outside directional antenna (ODA) 18, directed toward zone 12, is connected to the same beacon through a second channel or alternatively can be connected to a distinct beacon. Crossing line area 13*a* of zone 12 is covered by the ODA and crossing line area 13*b* of zone 11 is covered by IDA. The tag receives signal generated by ODA When staying within area 13*a*, and receives signal from IDA when staying within are 13*b*. A line crossing of an object from zone 12 zone 11 or vice versa is determined by a state machine of the tag processor. Crossing border line 14 from to zone 12 to zone 11 is detected by the tag state machine by the following sequence of steps:

Receiving ID transmission from ODA only

Receiving ID transmission from IDA only.

Stop of receiving ID transmission from IDA.

Crossing border line 14 in the opposite direction from zone 11 to zone 12 is detected by the tag state machine in the following sequence of steps:

Receiving ID transmission from IDA only.

Receiving ID transmission from ODA only.

Stop of receiving ID transmission from ODA.

Any other sequence of received ID transmitted by the ODA and IDA means that the tag may have been in the area of the crossing line but didn't cross the line.

Figure 2:
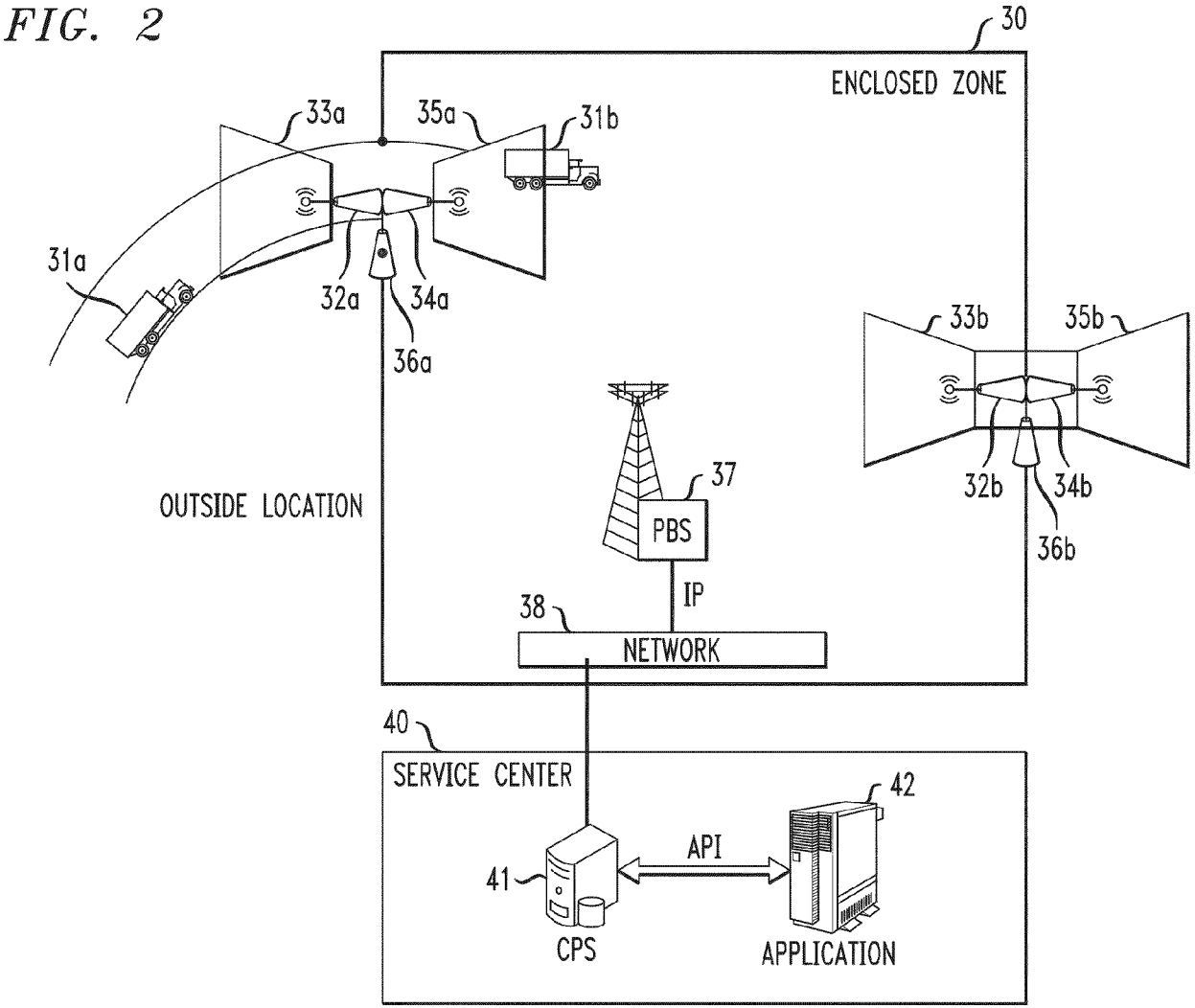
FIG. 2 schematically represents the architecture of the system according to one embodiment of the invention.

Reference is now made to FIG. 2 schematically illustrating system architecture of a truck center, which is an embodiment utilizing the apparatus of the present invention. An enclosed zone 30 consists of an entrance gate with an entrance gate detector and an exit gate with an exit gate detector. Entrance gate detector consisting outward directional antenna 32*a*, inward directional antenna 34*a* connected to beacon 36*a*. A truck 31*a* having an affixed tag, which is representing the truck fleet tracked by the system, is shown approaching the entrance gate. The approaching truck tag starts receiving data from beacon 36*a* when the truck is within area 33*a* covered by ODA 32*a*. The communication speed of the tag allows for several data exchanges while the truck is within the ODA area 33*a*. During gate entrance the truck is located partially within the enclosed zone and partially outside the gate. During this time the truck is mutually within area 33*a* and area 35*a* covered respectively by the IDA and ODA and receives beacon transmission of signals generated by ODA and IDA. Active area 33*a* adjacent to the gate has to be entirely outside the gate and active area 35*a* has to be entirely within the enclosed zone to assure reliable detection of gate crossing. When further moving into the enclosed zone, the truck designated 31*b* is within area 35*a* and only receiving beacon ID transmission of the IDA. When the truck is inside and further away from the gate, the tag is outside the IDA and ODA covered areas and stops receiving either ODA or IDA ID transmission. The tag processor detects reliably the event of entrance through the gate by the ID transmissions received from the beacon, regardless the truck maneuvering near the gate. As the entrance gate, the exit gate consists similarly of IDA 32*b* covering the area 33*b* and ODA 34*b* covering area 35*b* and both antennas are connected to beacon 36*b*. Tag operation during tag exit from the gate is similar to the tag operation during gate entrance except the detected direction is of exiting the gate. Each of the tags transmits through a wireless communication link, to a base station (PBS) 37, the tag location data according to detected gate crossing. The PBS 37 connected to a central processing server (CPS) 41, located in a service center 40, through an internet protocol (IP) network 38. The service center further consists of an application server 42 interfacing to the CPS via an application interface (API).

Figure 3:
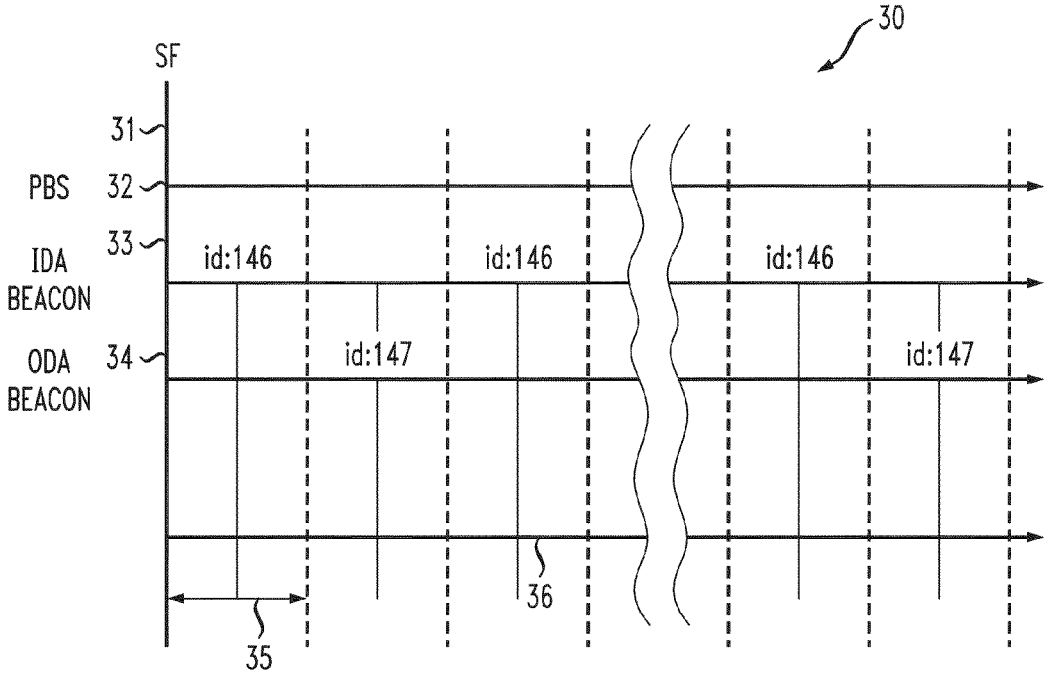
FIG. 3 schematically represents a timing diagram of a transmitting beacon and tag schedulers according to another embodiment of the invention; and, FIG. 4 schematically represents a state machine of a smart tag according to another embodiment of the invention.

Reference is now made to FIG. 3 schematically illustrating the system timing diagram of the communication link between a tag which is presenting all the tags in the system and a beacon presenting all the beacons in the system. The timing diagram 30 of the communication link consists of a pre-defined sequence synchronized with the system time base via a start frame (SF) message 31. During a transmission interval 35 the beacon transmits continuously frames consisting of the beacon identification number (ID), Transmission interval 35 of the beacon alternating between IDA beacon 33 and ODA beacon 34 is a variable parameter of the system. In one embodiment of the system beacon ID is an 8 bit integer having a value assigned to each of the two antennas. The IDA beacon ID is an even integer and ODA beacon ID is odd number greater by 1 from the IDA beacon ID. For example, depicted in this figure are: IDA beacon ID=146 and ODA beacon ID=147. Every beacon transmission cycle consists of a time window 36 assigned for a tag to receive beacon transmitted ID.

Figure 4:
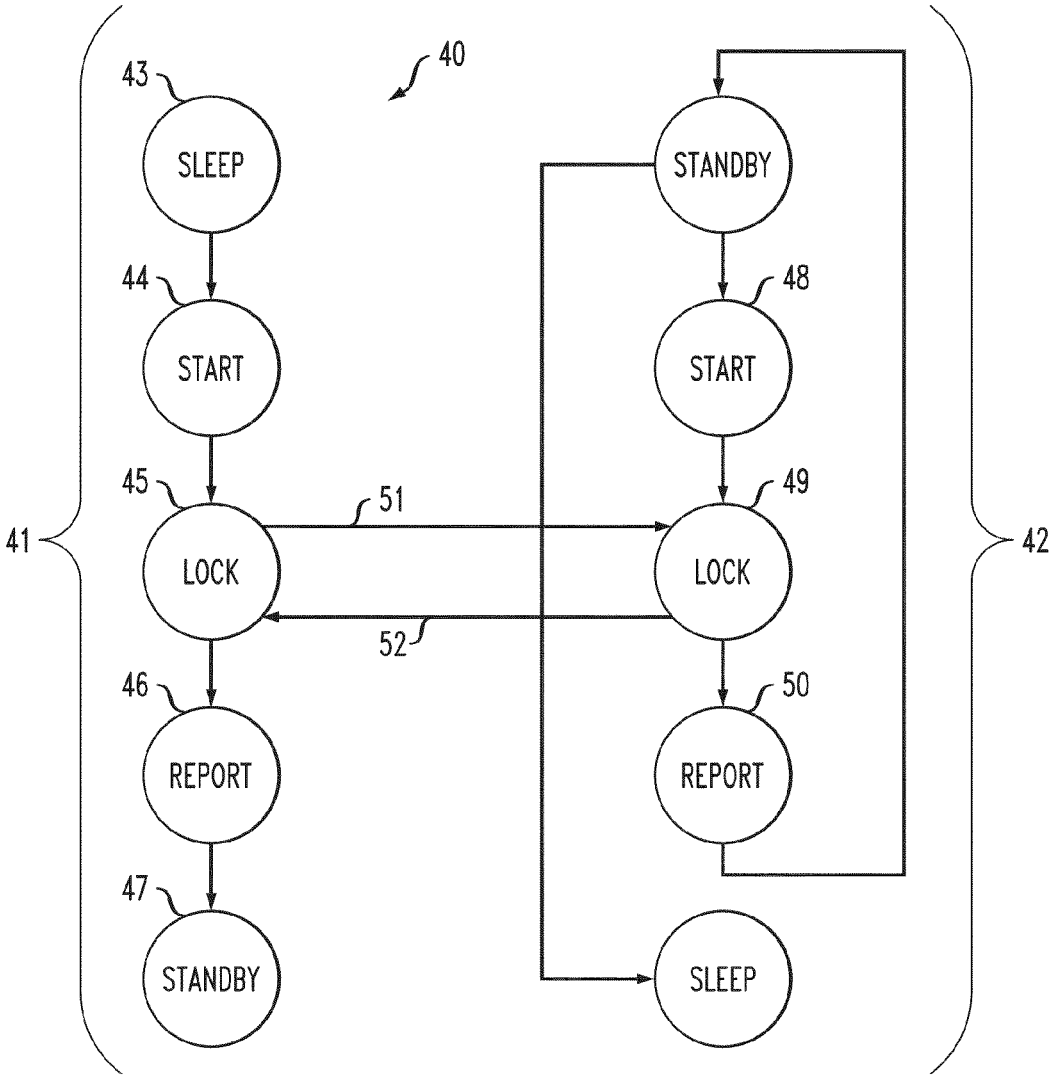

Reference is now made to FIG. 4 schematically illustrating the state machine of a tag carrying out the task of line crossing detector. The tag state machine depicts graphically a sequence of steps leading to detection of line crossing whereas each new step is defined by the present state and an input received from the RF beacon. Tag state machine 40 consists branch 41 associated with entering a gate and branch 42 associated with exiting the gate. When the tag is outside the enclosed zone it gets into a 'SLEEP' state 43. While the tag is in 'SLEEP' state, the tag receiver opens occasionally and asynchronous the receiver, to detect whether an ODA ID is received. When the tag detects an RF beacon transmission of an ODA ID, meaning the tag approaches the gate, the tag enters 'START' state 44. When the tag is entering the gate the tag keeps receiving ODA ID transmitted by the RF beacon. In the gate entrance event, branch 41 of the state machine is being followed. After crossing the gate line the tag starts receiving IDA ID and enters into the 'LOCK' state 45. 'LOCK' states 45 and 49 represent the ambivalent event occurring when the tag is in the gate yet has not crossed the gate line into or out off the enclosed zone. A discontinued IDA ID transmission while the tag is in 'LOCK' state 45 is indicating that the tag entered the gate and is within the enclosed zone. In that event the tag enters 'REPORT' state 46, indicating that the tag entered the gate and reporting the gate entrance event to the central processor through a wireless communication link. After reporting gate entrance and while staying within the enclosed zone, the tag enters the 'STANBY' state 47, waiting for a received IDA ID when it is approaching the gate for exiting the enclosed area. While the tag is at 'LOCK' state 45, the tag may refrain from entering the gate for whatever reason. While in 'LOCK' state 45, if an ODA ID is received, it is indicating that the tag is still in the gate area and did not enter the gate. In that event, the tag enters 'LOCK' state 49 through arrow 51. The tag can be alternating between lock state 45 and lock state 49 through arrows 51 52, indicating that the tag did not leave the gate area and therefore gate entrance or gate exit events are not definite yet. When the tag is inside the enclosed zone, the tag stays in state 'STANBY' 47 and the tag receiver is operational. When the tag is approaching the gate to exit the enclosed zone, upon receiving an IDA ID, the tag enters 'START' state 48 in branch 42. The tag enters 'LOCK' state 49 when an ODA ID is further received. As in the gate entrance event, described in the preceding section, the tag stays in 'LOCK' state 49 while staying in the gate area, i.e., ODA ID transmission goes on being received. In the event that the tag stays in the gate area, the tag may alternate between 'LOCK' state 49 and 'LOCK' state 45 through arrows 51 and 52. When the tag stops receiving ODA ID transmission, indicating a gate exit event, the tag enters 'REPORT' state 50, reporting the gate exit event through a wireless communication link enters 'SLEEP' state 43 through 'SATANBY' state 47, while staying outside the enclosed zone.

According to one embodiment of the present invention, a crossing detection system is provided by disposing one outward directed antenna and one inward directed antenna connected to an RF beacon wherein the two antennas are substantially directional. Inward directed antenna and outward directed antenna have pre-defined coverage area on the inside and the outside of the gate. A smart tag affixed to an object being tracked for entering and leaving the area through the gate receives the RF beacon transmission and determines reliably a gate entrance and a gate exit events.

In another embodiment the invention can be adaptable to crossing a border line between any two zones, like for example, crossing a bridge, passing a toll booth or tracking specific locations spread through the object tracking area. Line crossing detection is utilized by the smart cards of the system, and line crossing detection is distributed through all the tags rather than being at a specialized central location. Due to the tag distributed processing capability, simple devices can be used at the crossing site and thus line crossing places can be utilized at various and remote locations.

In another embodiment of the invention, the two directional antennas may be configured as an RF controlled antenna array, providing further flexibility by the provision to modify actively antenna beams and adapting a single antenna array for variable coverage areas.

The invention claimed is:

1. An apparatus for detecting the crossing of a border line section between a first zone and a second zone, comprising:

i. an antenna assembly located near said border line section, comprising:

(a) a first antenna section connected to a first transmitter, having a directional antenna with a radiating element oriented in a first direction and a radiation pattern aligned to radiate greater power in the first direction, and (b) a second antenna section connected to a second transmitter, having a directional antenna with a radiating element oriented in a second direction opposite the first direction and a radiation pattern aligned to radiate greater power in the second direction;

wherein said first antenna section is directed from said border line section toward said first zone and said second antenna section is directed from said border line toward said second zone, and ii. a smart tag that can be affixed to an object;

wherein said smart tag detects an event of said smart tag crossing said border line section, by receiving transmission of identification data of said first antenna section but not of said second antenna section when said smart tag is in said first zone, and then receiving transmission of identification data of said first antenna section and said second antenna section simultaneously, and then receiving transmission of identification data of said second antenna section but not of said first antenna section when said smart tag is in said second zone and then detecting that receipt of said transmission of identification data of said second antenna section has stopped while transmission of identification data of said first antenna section is not being received.

2. The apparatus according to claim 1, wherein said first antenna section comprises a first linear antenna and said second antenna section comprises a second linear antenna, wherein said linear antennas are mounted back to back.

3. The apparatus according to claim 2, wherein said first linear antenna is connected to a first channel of a beacon and said second linear antenna is connected to a second channel of said beacon.

4. The apparatus according to claim 1, comprising a phased antenna array driven by an RF signal for configuring a radiation pattern similar to a first linear antenna and a second linear antenna mounted back to back.

5. The apparatus according to claim 2, wherein said first linear antenna is connected to a first beacon and said second linear antenna is connected to a second beacon.

6. An apparatus according to claim 1 configured as a tracking system, comprising a plurality of smart tags affixed to a plurality of objects, wherein said smart tags transmit to a base station of said system via a wireless communication link, reports associated with said detected border line section crossing from said first zone to said second zone and vice versa.

7. The tracking system according to claim 6, wherein said base station is connected via an IP network to a service center comprising a central processing server and a customer application server.

8. The tracking system according to claim 6, comprising an enclosed zone and at least one gate, each of said plurality of smart tags detects gate entrance and gate exit and reports to said service center said gate entrance and gate exit.

9. The tracking system according to claim 6, wherein said cross line section between said first zone and said second zone are in an outdoor setting.

10. A method for detecting the crossing of a border line section between a first zone and a second zone from said first zone to second zone and vice versa, comprising:

i. providing an antenna; said antenna comprising;

(a) a first antenna section connected to a first transmitter, having a directional antenna with a radiating element oriented in a first direction and a radiation pattern aligned to radiate greater power in the first direction, and (b) a second antenna section connected to a second transmitter, having a directional antenna with a radiating element oriented in a second direction opposite the first direction and a radiation pattern aligned to radiate greater power in the second direction;

said first antenna section is directed from said border line section toward said first zone and said second antenna section is directed from said border line section toward said second zone, and ii. providing a smart tag affixed to an object;

wherein detecting an event of said smart tag crossing said border line section is processed by a tag state machine, the detecting comprising:

(a) receiving by said smart tag identification transmission of said first antenna section but not of said second antenna section when said smart tag is in said first zone and then (b) receiving transmission of identification data of said first antenna section and said second antenna section simultaneously, and then (c) receiving identification transmission of said second antenna section but not of said first antenna section when said smart tag is in said second zone, and then (d) detecting that receipt of said transmission of identification data of said second antenna section has stopped while transmission of identification data of said first antenna section is not being received.

11. The method according to claim 10, comprising assigning a first integer as identification number for said first antenna section and a second integer as identification number for said second antenna section.

12. The method according to claim 11, comprising assigning said first integer an even number and assigning said second integer an odd number greater by one from said first integer.

13. The method according to claim 10, comprising providing said detection of crossing said border line section by said tag state machine; said state machine comprising a first branch and a second branch.

14. The method according to claim 13, comprising operating continuously a receiver of said smart tag receiver during a standby state of said state machine.

15. The method according to claim 13, comprising entering a start state of said state machine when said first antenna section or said second antenna section are transmitting identification data.

16. The method according to claim 14, comprising entering a lock state and staying in said lock state of said state machine when said smart tag is receiving said identification transmission from only said first antenna section or only from second antenna section.

17. The method according to claim 13, further comprising entering a crossing report state of said state machine when receipt of said second antenna section identification transmission stops.

18. The method according to claim 13, comprising entering a sleep state of said state machine after detecting said line section crossing from said first zone to said second zone.

19. The tracking system according to claim 7, comprising an enclosed zone and at least one gate, each of said plurality of smart tags detects gate entrance and gate exit and reports to said service center said gate entrance and gate exit.

20. An apparatus for detecting the crossing of a border line section between a first zone and a second zone, comprising:

a smart tag configured to be affixed to an object movable between the first zone and the second zone, said smart tag configured to detect an event of said smart tag crossing said border line section, by:

receiving transmission of identification data of a first antenna section but not of a second antenna section when said smart tag is in said first zone and then receiving transmission of identification data of said first antenna section and said second antenna section simultaneously, and then receiving transmission of identification data of said second antenna section but not of said first antenna section when said smart tag is in said second zone and then detecting that receipt of said transmission of identification data of said second antenna section has stopped while transmission of identification data of said first antenna section is not being received;

wherein said first antenna section is located near said border line section and connected to a first transmitter, said first antenna section having a directional antenna with a radiating element oriented in a first direction and a radiation pattern aligned to radiate greater power in the first direction, said second antenna section is located near said border line section and connected to a second transmitter said second antenna section having a directional antenna with a radiating element oriented in a second direction opposite the first direction and a radiation pattern aligned to radiate greater power in the second direction; and said first antenna section is directed from said border line section toward said first zone and said second antenna section is directed from said border line section toward said second zone.

21. The method of claim 10, further comprising determining that the smart tag has been near the border line but has not crossed the border line if the identification transmission of either the first or second antenna section is detected, but steps (a), (b) and (d) are not all performed sequentially.

* * * * *

UNITED STATES PATENT AND TRADEMARK OFFICE

CERTIFICATE OF CORRECTION

PATENT NO. : 8,130,104 B1
APPLICATION NO. : 12/646039
DATED : March 6, 2012
INVENTOR(S) : Michael Braiman It is certified that error appears in the above-identified patent and that said Letters Patent is hereby corrected as shown below:

Claim 1, column 8, line 49, after "line" insert -- section --.

Signed and Sealed this
Fifth Day of February, 2013

Teresa Stanek Rea
*Acting Director of the United States Patent and Trademark Office*